US008828171B2

(12) United States Patent
Wust et al.

(10) Patent No.: US 8,828,171 B2
(45) Date of Patent: Sep. 9, 2014

(54) USE OF A FIBRE-REINFORCED PLASTIC MATERIAL AS A REINFORCEMENT SYSTEM OF A PROFILE FOR A WINDOW OR DOOR FRAME

(75) Inventors: Manfred Wust, Ettringen (DE); Andreas Heilig, Graben-Neudorf (DE); Angelika Homes, Laudenbach (DE); Florian Hennenberger, Heppenheim (DE); Michael Kay Brockmuller, Neustadt an der Weinstrasse (DE)

(73) Assignee: aluplast GmbH, Karlsruhe (DE)

( * ) Notice: Subject to any disclaimer, the term of this patent is extended or adjusted under 35 U.S.C. 154(b) by 0 days.

(21) Appl. No.: 12/866,530

(22) PCT Filed: Feb. 6, 2009

(86) PCT No.: PCT/EP2009/000827

§ 371 (c)(1),
(2), (4) Date: Aug. 6, 2010

(87) PCT Pub. No.: WO2009/098068

PCT Pub. Date: Aug. 13, 2009

(65) Prior Publication Data

US 2010/0319843 A1 Dec. 23, 2010

(30) Foreign Application Priority Data

Feb. 8, 2008 (DE) ..... 10 2008 008 343

(51) Int. Cl.
*E06B 3/673* (2006.01)
*E06B 3/22* (2006.01)
*E06B 3/263* (2006.01)

(52) U.S. Cl.
CPC ..... *E06B 3/221* (2013.01); *E06B 2003/26327* (2013.01); *E06B 2003/228* (2013.01)
USPC ..... 156/244.13

(58) Field of Classification Search
USPC ..... 156/244.13
See application file for complete search history.

(56) References Cited

U.S. PATENT DOCUMENTS

| | | | | | |
|---|---|---|---|---|---|
| 4,492,063 | A * | 1/1985 | Schock et al. | ..... | 52/309.7 |
| 4,769,951 | A * | 9/1988 | Kaaden | ..... | 49/502 |
| 5,378,077 | A * | 1/1995 | Paulsen | ..... | 403/402 |
| 5,727,356 | A * | 3/1998 | Ensinger et al. | ..... | 52/717.02 |
| 6,221,947 | B1 * | 4/2001 | Hironaka | ..... | 524/405 |
| 6,920,726 | B2 * | 7/2005 | Bielefeld et al. | ..... | 52/204.53 |
| 2003/0157280 | A1 * | 8/2003 | Boissonnat et al. | ..... | 428/34.1 |
| 2006/0287468 | A1 * | 12/2006 | Hwang et al. | ..... | 528/170 |

FOREIGN PATENT DOCUMENTS

| | | | |
|---|---|---|---|
| DE | 19933099 | | 1/2001 |
| EP | 1693546 | A1 * | 8/2006 |
| WO | 0106079 | | 1/2001 |
| WO | 0181072 | | 11/2001 |
| WO | WO 0181072 | A1 * | 11/2001 |

* cited by examiner

*Primary Examiner* — Philip Tucker
*Assistant Examiner* — Vicki Wu
(74) *Attorney, Agent, or Firm* — Volpe and Koenig, P.C.

(57) ABSTRACT

The use of a fiber-reinforced plastic material as reinforcement strips (2, 6, 7, 14, 15) of a window or door frame hollow profile (1, 10) is provided, with the fiber-reinforced plastic material having an E-module that is >8.000 N/mm$^2$, and preferably >10.000 N/mm$^2$, having a softening temperature of >100° C., and preferably >150° C. and an elongation coefficient of $<6\cdot10^{-5}K^{-1}$, and preferably $<5\cdot10^{-5}K^{-1}$ most preferably $<4\cdot10^{-5}K^{-1}$, in particular fiber-reinforced polybutylenterephtalate, polyetylenterephtalate or a mixture thereof.

7 Claims, 3 Drawing Sheets

USE OF A FIBRE-REINFORCED PLASTIC MATERIAL AS A REINFORCEMENT SYSTEM OF A PROFILE FOR A WINDOW OR DOOR FRAME

BACKGROUND

The invention relates to the use of a fiber-reinforced plastic as a reinforcement system for a window or door frame hollow profile, which may particularly be embodied as a multi-chamber, extruded hollow profile comprising thermoplastic material.

Such a profile is known, among other things, from WO 01/06079, with both plastic as well as steel being mentioned as the material for the reinforcement system, embodied in the form of strip or bar-shaped reinforcement elements, with the steel variant being set apart by poorer heat insulation in reference to the plastic reinforcement. However, the heat insulation is of increasing importance in window construction. The reinforcement elements of WO 01/06079 may show punched recesses particularly at their opposite longitudinal edges, which enter into a form-fitting engagement with a frame profile.

Additionally, in DE 199 33 099 a plastic hollow-profile for windows or doors has become known in which the reinforcement system comprises metallic strips, which are connected to the plastic hollow profile in a form-fitting fashion via recesses. In order to produce these recesses the metallic strip must be locally punched, which requires additional production expenses.

If a window frame is to be produced from such profiles, the respective profile sections are sawed in a mitered fashion and welded to each other at the corner sections. When the profile is provided with reinforcements made from a metallic material, it must be ensured prior to welding that the reinforcement is recessed by a few millimeters at the ends of the plastic profile in order to not contact the welding hot-plate and thus preventing the feeding motion during the heating of the thermoplastic material. This is achieved in separately inserted reinforcement profiles such that an appropriately shortened profile is used. In reinforcement profiles, with the reinforcement embedded during the extrusion process, the reinforcement must be cut down by a few millimeters. Both measures aggravate the production of the frame.

The same problem arises when instead of a metallic reinforcement, the reinforcement is fiberglass-reinforced plastic profiles that are made from a thermoset material. The known fiberglass-reinforced PVC-profiles are of insufficient stability to withstand all stress potentially applied.

SUMMARY

The object of the present invention is therefore to provide a plastic suitable for the application mentioned at the outset, which may be used as a reinforcement strip for the hollow profile of a door or window frame such that on the one hand the resulting profile is sufficiently stable and on the other hand it is characterized in low production expenses as well as high thermal insulation.

This object is attained according to the invention in that a very particular plastic is selected from the almost innumerable multitude of plastics known, which has an E-modulus >8,000 N/mm$^2$, preferably >10,000 N/mm$^2$, a softening temperature >100° C., preferably >150° C., and an elongation coefficient $<6\cdot10^{-5}$ K$^{-1}$, preferably $<5\cdot10^{-5}$ K$^{-1}$, most preferably $<4\cdot10^{-5}$ K$^{-1}$, and that this plastic that is at least primarily in the form of fiber-reinforced polybutylene-terephthalate, polyethylene-terephthalate, or mixtures thereof, is installed as a reinforcement strip of the hollow profile of a window or door frame.

Firstly, this results in the advantage that no metallic reinforcement is used and thus any worsening of the heat insulation caused thereby is avoided.

The elongation coefficient of the plastic used according to the invention preferably amounts to a value at least 10% lower than the one of PVC. The combination of a high E-modulus, high softening temperature, and low elongation coefficient is advantageous in that, in addition to the static requirements, the reinforcement system reacts essentially more efficiently to temperature influences by limiting thermally-caused changes in elongation of the hollow profile to a considerably greater extent.

The plastic reinforcement itself can be profiled to form a positive fit effective in the plane of the frame in reference to the hollow profile by shapes projecting in the lateral direction of the reinforcements, such as strips or the like, so that a form-fitting connection of the reinforcement system with the hollow profile is provided by the profiling of the reinforcement. This way, any punching of the reinforcement can be avoided because the positive fit is formed by the lateral alignment of the parts projecting from the reinforcement, which are produced together with said reinforcement. This way, a strong reinforcement of the plastic hollow profile is yielded with low production expenses.

The profiling of the reinforcement may run over the entire longitudinal extension or be provided only sectionally.

A beneficial embodiment of said profiling comprises that it is formed by a beading at the edges of the reinforcement strip.

Anyone trained in the art will know a multitude of measures suitable to form the reinforcement. Preferably narrow reinforcement strips are being used, which are arranged vertically inside the profile, i.e. parallel in reference to the plane of the frame, namely preferably at the proximity of the side of the profile facing the outside of the building. Here, the most severe temperature changes occur and thus it is recommended to provide the reinforcement strips at this position, which shall also serve to reduce any thermally caused elongations.

The reinforcement strips can be provided either separately, for example in the form of coils and fed to the extrusion nozzle, or they are beneficially themselves extruded as continuous strips and fed to the nozzle, simultaneously with the extrusion process of the hollow profile. In both cases the advantage results that the reinforcement is extruded together with the hollow profile and thus an interior force-fitting and perhaps also material-fitting connection develops between the two parts.

Additionally it has proven beneficial to use a plastic for the reinforcement system, which is characterized in a low absorption of moisture such that the increase in weight by absorbed moisture amounts to less than 0.5%, preferably less than 0.25%. This way, the reinforcement system maintains the desired resistance values even in the moist condition. The above-mentioned features can be ensured by the above-mentioned polybutylene-terephthalate and/or polyethylene-terephthalate.

Previously, such plastics have been used for injection-molded circuit boards and housings for small engines, for example, so that their use for window construction has not been obvious for one trained in the art, particularly not the special use as an extruded reinforcement strip inside a hollow profile made from a different plastic material.

With regards to the processing temperature of the reinforcement system, i.e. the temperature at which the welding of abutting profile sections occurs, it is recommended for said temperature to range from 220° C. to 300° C., preferably amounting to about 250° C. This way, the reinforcement produced is optimally suited for the common method of hot-plate welding, which is used to connect successive profile sections.

Preferably the use of the above-mentioned plastic occurs in such a fashion that the reinforcement strip is extruded positioned approximately vertically in a multi-chambered plastic hollow profile and is connected at least at its top and bottom end with said plastic hollow profile.

BRIEF DESCRIPTION OF THE DRAWINGS

Additional features and advantages of the invention result from the following description of an exemplary embodiment and the drawing. Shown here are.

DETAILED DESCRIPTION OF THE PREFERRED EMBODIMENTS

Figure 1:
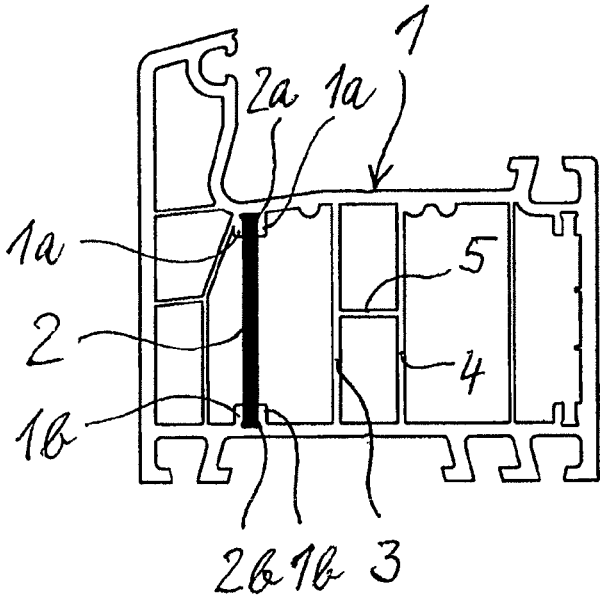
FIG. 1 a cross-sectioned profile view of the door or window frame.

In FIG. 1 a hollow profile 1 of a door or window frame is discernible having an integrated reinforcement 2 according to the invention.

The exterior contour of the extruded PVC-hollow profile 1 corresponds to the hollow profiles of prior art such that it is compatible to conventional casements. However, the division of the interior space of the hollow profile 1 deviates from the profiles of prior art in various ways:

On the one hand, the largely free-standing reinforcement 2 is located in the half of the profile facing the outside of the building in the form of a vertical strip, i.e. extending parallel in reference to the plane of the frame and comprises polybutylene-terephthalate having a fiber-glass content of more than 40%, an E-modulus of 12,000 N/mm$^2$, a softening temperature of >200° C., and an elongation coefficient of approximately $3\cdot10^{-5}$ K$^{-1}$. This reinforcement strip is beaded at its upper and lower edge each in both lateral directions and said beads 2*a* and 2*b* are integrated in a clamp-like fashion in the wall parts 1*a* and/or 1*b* extending into the interior of the profile. Due to the fact that the hollow profile 1 is extruded together with the reinforcement 2 a force-fitting (caused by friction) connection develops between the two parts as a consequence of the shrinkage of the cooling PVC and furthermore an effective form-fitting connection results in the direction of the plane of the frame, thus in FIG. 1 in the vertical direction. The connection can be even further intensified in the reinforcement, in a preferred further development, comprising a knurling or a similar roughening in the area of the connection to the hollow profile, which in the longitudinal direction of the profile creates a quasi-form-fitting connection.

On the other hand, instead of the common reinforcement chambers of the prior art, the hollow profile 1 includes two vertical walls 3 and 4, which cross the hollow profile in the vertical direction and which preferably are also connected beneficially to a lateral wall 5. This way, they form a reinforcement in the central area of the hollow profile, in which assembly screws, anchors, and the like can be attached in order to connect the casement to the masonry.

Figure 2:
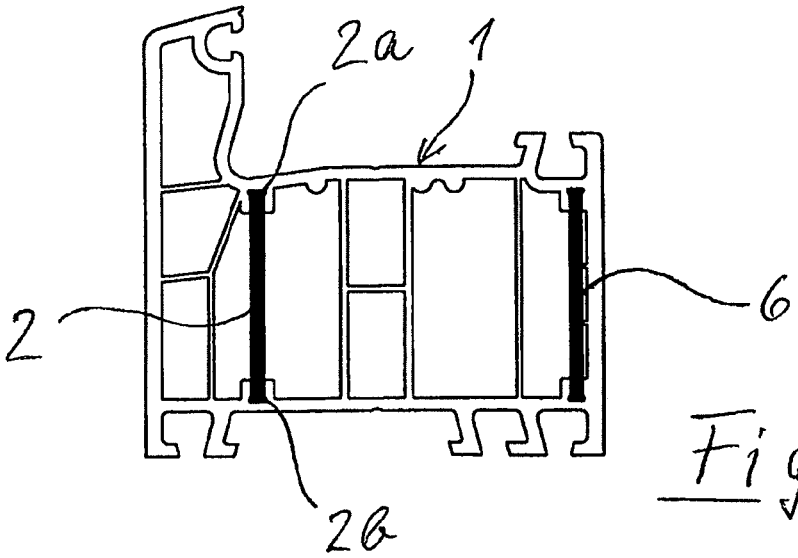
FIG. 2 an alternative cross-sectioned profile view of the door or window frame.

FIG. 2 shows the same cross-section, in principle, however here additionally a reinforcement 6 is arranged parallel in reference to the reinforcement 2, however in the proximity of the right interior wall of the hollow profile 1. The reinforcement 6 has the same shape as the reinforcement 2, in principle, and has also been extruded together with the hollow profile 1.

Figure 3:
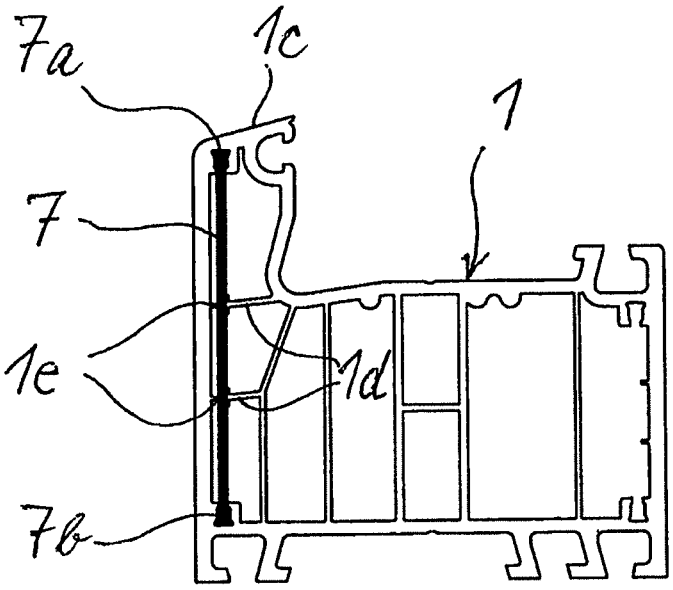
FIG. 3 another alternative view for the door or window frame.

While the reinforcements 2 in FIGS. 1 and 2 each extend only over the lower cross-section of the profile, in FIG. 3 a reinforcement 7 is provided closer to the exterior side of the profile, so that it also reaches into the profile extension 1*c* extending upwards. It only extends with a narrow gap adjacent to the exterior wall of the profile and is also beaded at its upper and lower edge towards both lateral sides such that its beads 7*a* and 7*b* are also encompassed by corresponding wall sections of the hollow profile 1 and/or 1*c* and a form-fitting connection develops.

Additionally, in this case horizontal wall projections 1*d* and 1*e* also project into the intermediate space in the reinforcement 7. The reinforcement 7 therefore causes an additional stiffening of the hollow profile in the lateral direction.

Figure 4:
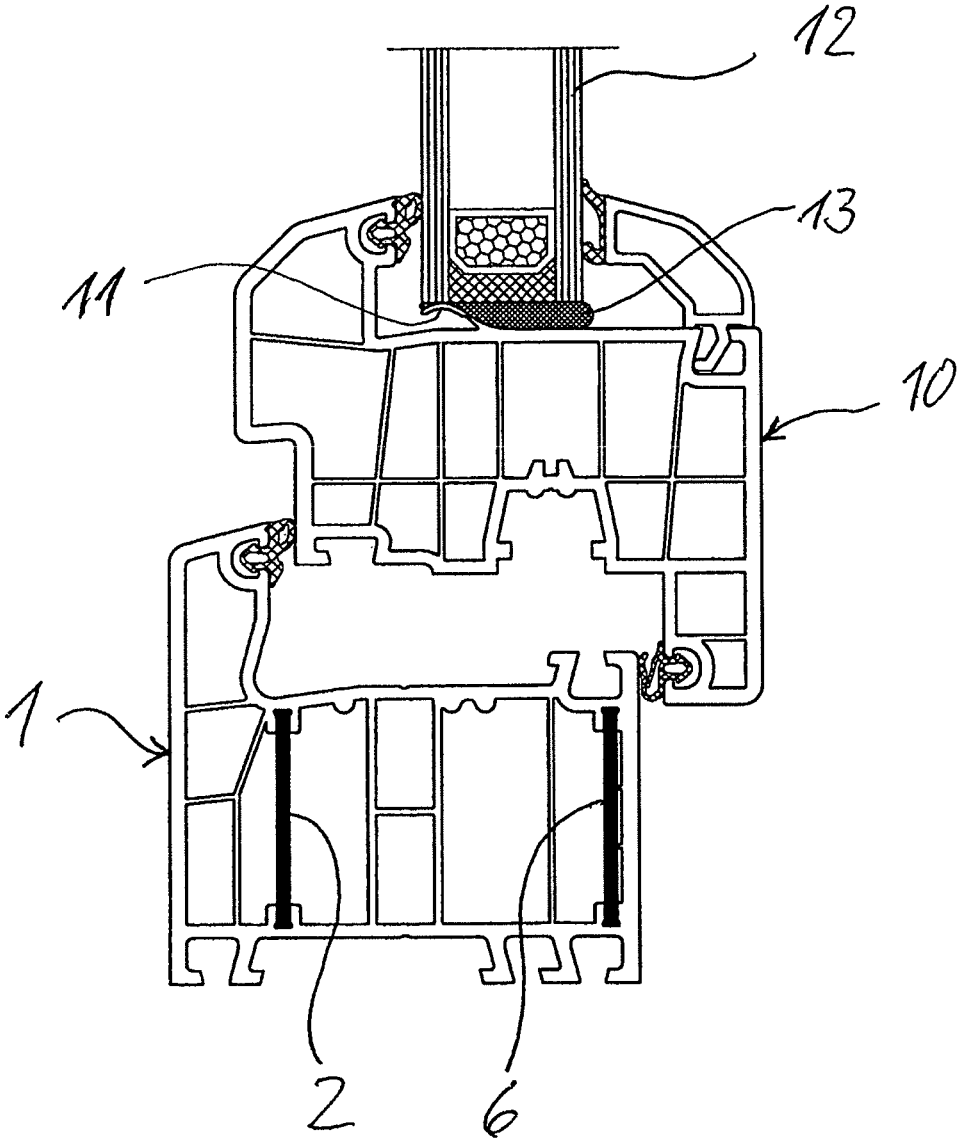
FIG. 4 a cross-sectional view through the door or window frame.

FIG. 4 shows the cooperation of the above-described casement 1 with a window frame 10. This window frame has a configuration known per se. It particularly has a centering lip 11, which facilitates the insertion of the glass and additionally allows the formation of a chamber to accept the adhesive 13 connecting the glass to the window frame.

Figure 5:
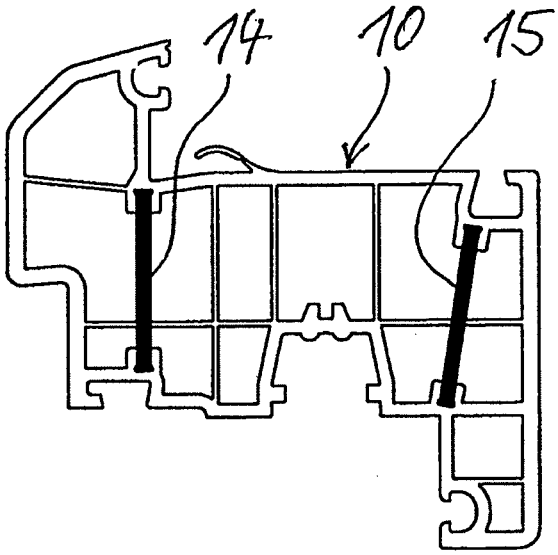
FIG. 5 a cross-sectioned profile view of the door or window frame.

FIG. 5 shows that the reinforcement according to the invention is suitable for the casement just as well. For this purpose, the hollow profile 10 is crossed each in the left half and optionally also in the right half by one reinforcement 14 and 15, respectively. Both reinforcements are in turn beaded at their ends and here encompassed by corresponding wall sections of the hollow profile 10.

Finally, FIG. 5 shows, using the example of the reinforcement 15, that it is also possible to integrate the reinforcement not vertically but in an inclined fashion.

In all exemplary embodiments the reinforcement according to the invention results, unlike metallic reinforcement strips, in a good heat insulation with excellent sturdiness and dimensional stability.

The invention claimed is:

1. A method of forming a window or door frame, comprising:

extruding hollow frame members of a thermoplastic material; and coextruding reinforcement strips simultaneously into the hollow frame members as the hollow frame members are extruded with upper and lower edges of the reinforcement strips being beaded, and said beads integrated in a clamped fashion in wall parts of the hollow frame members so the reinforcement strips are generally free-standing, the reinforcement strips being formed of fiber-reinforced plastic having an E-modulus >8,000 N/mm$^2$, a softening temperature >100° C., and an elongation coefficient $<6\cdot10^{-5}$ K$^{-1}$.

2. The method of claim 1, wherein the E-modulus is >10,000 N/mm$^2$, the softening temperature is >150° C., and the elongation coefficient is $<5\cdot10^{-5}$ K$^{-1}$.

3. The method of claim 1, wherein the elongation coefficient is $<4\cdot10^{-5}$ K$^{-1}$.

4. The method of claim 1, wherein the fiber-reinforced plastic comprises polybutylene-terephtalate, polyethyelene-terephalate, or mixtures thereof.

5. The method of claim 1, further comprising:

extruding the reinforcement strip(s) (2, 6, 7, 14, 15) into a multi-chamber plastic hollow profile (1, 10) that forms the frame members and connecting the reinforcement strips at least at top and bottom ends thereof to the plastic hollow profile (1, 10).

6. The method of claim 5, wherein the reinforcement strip(s) (2, 6, 7, 14, 15) are extruded in the multi-chamber plastic hollow profile (1, 10) standing approximately vertically.

7. The method of claim 1, further comprising forming a force-fitting or material-fitting connection between the reinforcement strips and the hollow frame members.

* * * * *